United States Patent [19]

Saeman

[11] 4,071,962

[45] Feb. 7, 1978

[54] ROTARY DRYERS

[75] Inventor: Walter C. Saeman, Cleveland, Tenn.

[73] Assignee: Olin Corporation, New Haven, Conn.

[21] Appl. No.: 671,173

[22] Filed: Mar. 29, 1976

[51] Int. Cl.[2] ..... F26B 11/04

[52] U.S. Cl. ..... 34/135; 34/25; 34/66; 432/118

[58] Field of Search ..... 34/66, 135, 136, 137, 34/141, 216, 217, 25, 20, 33, DIG. 2; 259/3; 432/106, 110, 118

[56] References Cited

U.S. PATENT DOCUMENTS

| | | | |
|---|---|---|---|
| 1,871,934 | 8/1932 | West et al. | 34/33 |
| 2,675,629 | 4/1954 | Fisher | 34/135 X |
| 2,924,513 | 2/1960 | Altimier et al. | 34/135 X |
| 3,101,936 | 8/1963 | Loewen | 34/135 X |
| 3,258,849 | 7/1966 | Raitt | 34/141 X |
| 3,866,888 | 2/1975 | Dydzyk | 259/3 X |
| 3,871,829 | 3/1975 | Keith et al. | 34/137 X |

FOREIGN PATENT DOCUMENTS

| | | | |
|---|---|---|---|
| 818,014 | 8/1959 | United Kingdom | 34/66 |

*Primary Examiner*—William F. O'Dea
*Assistant Examiner*—Harold Joyce
*Attorney, Agent, or Firm*—Bruce E. Burdick; Donald F. Clements; Thomas P. O'Day

[57] ABSTRACT

A rotary dryer in which the rate of the bed transport is adjustable. The dryer shell is provided with at least one set of flights and a dam ring with the dam ring being spaced downstream of the flights to provide a flight-free area. Adjustable means are provided to transport material from the flight-free area over the dam ring to the downstream side thereof upon rotation of the shell to vary the amount of material retained upstream from the dam ring. In addition, means are provided to convey material from the flight-free area to a point adjacent the upstream end of the flights. Further, a cooling section is also included comprising a plurality of flights. Means for supplying co-current drying gas may be provided at the feed end of the dryer and means for supplying counter-current cooling gas may be provided adjacent the discharge end.

22 Claims, 5 Drawing Figures

ROTARY DRYERS

BACKGROUND OF THE INVENTION

This invention relates generally to rotary dryers, and more particularly, to an improved means and method for controlling the transport rate of the bed in such dryers.

Rotary dryers are widely used for thermally processing and drying coarse- and fine-grained solids. Rotary dryers generally include a hollow cylindrical shell with open ends which is mounted for rotation about its axis. The axis may be slightly inclined from the horizontal plane. The interior surface of the shell may be provided with flights or lifters for elevating and showering the solids as the dryer rotates. The showering affords intimate contact of the solids with the gases which are channelled through the cylindrical shell.

Coolers are similar to rotary dryers, but opposite in function. The dryers are supplied with heated air to volatize moisture or solvent from the solids in the dryer bed, whereas coolers are supplied with unheated or cooled air to extract excess heat from the hot solids. In other respects, the relationships governing the heat transfer and bed transport rate through the shell are substantially similar.

Air flow through rotary dryers or coolers may be co-current or counter-current in relation to the direction of solids transport. Mathematical relationships which govern bed transport and heat transfer in rotary dryers have been published in the technical literature. For example, see the article appearing in *Chemical Engineering Progress,* September 1954, pp. 467 – 475, by W. C. Saeman and T. R. Mitchell, and also an article appearing in *Chemical Engineering Progress,* June, 1962, pp. 49 – 56, by W. C. Saeman.

According to the relationship proposed in the paper by Saeman and Mitchell, the rate of bed transport in a rotary cylinder equipped with flights and operating with counter-current air flow may be expressed as follows:

$$V = CDR(S - mA)$$

wherein $V$ equals the horizontal transport velocity in feet per minute, $C$ equals a constant with an assigned value in the range of 2 to 3 (usually 2.6), $D$ equals diameter of the cylinder in feet, $R$ equals rate of rotation in revolutions per minute, $S$ equals slope of the axis in feet per foot of axial distance, $m$ equals a coefficient to relate air velocity effects to equivalent slope effect, and $A$ equals air velocity in units compatible with the coefficient $m$.

If air velocity is expressed as feet per second, the value of the coefficient $m$ is in the range of 0.003 to 0.010. In cases where the cylinder is operated with co-current air flow, the factor $(S - mA)$ is generally replaced with $(mA + S)$, although in some instances $(mA - S)$ may also apply.

In typical cases, the air flows through dryers and coolers in the range of 3 to 10 feet per second. The value of the term $mA$ with $m$ equal to 0.005 would thereupon be in the range from 0.015 to 0.05. Thus, assuming the case of a cylinder 10 feet in diameter and rotating at 10 rpm, even with zero slope ($S = 0$) the rate of bed transport by co-current air transport alone lies in the range of 3.75 to 12.50 feet per minute when the value of the coefficient C is 2.5. A dryer 40 feet long would then be transversed in about 3 to about 10 minutes.

The required retention time in dryers varies with different materials and typically ranges from 10 minutes to over 100 minutes. It is thus apparent that where the desired retention time is greater than that allowed by the bed transport rate, some means of retarding bed transport must be applied to diminish the relatively rapid air transport rate.

One common practice used to retard the bed transport rate is to operate the dryer with an axial slope in such a direction that it opposes the air transport effect so that the net bed transport rate is the difference between the two. Thus, if a negative slope of 0.01 is combined with the $mA$ value as indicated above, the values of the combined factors $(mA - S)$ for the conditions specified above becomes 0.005 and 0.040, thereby reducing the bed transport rates from 3.75 and 12.50 feet per minute to 1.25 and 10 feet per minute at co-current air velocities of 3 and 10 feet per minute respectively. At an air velocity of 3 feet per second, bed retention time is thereby extended from 10 minutes to over 30 minutes, while bed retention is extended only slightly from 3 to 4 minutes at the higher air velocity. It is therefore apparent that this method of bed transport retardation is effective only if the slope of the cylinder is readjusted in conformity with the term $(mA - S)$ or $(S - mA)$ for any particular value of air rate, or vice versa, as the bed transport rate is proportional to the difference between the two terms. Because of this relation, variations in air rate are inflexibly tied to variations in the axial slope. However, because of the massiveness of industrial rotary dryers, the slope cannot be conveniently altered, hence the air rate must be held within relatively narrow limits of variation, which is difficult in many instances.

Another way to reduce the bed transport rate would be to reduce the speed of rotation of the drum. However, in the publication by Saeman and Mitchell mentioned above, it is demonstrated that the heat transfer rate between air and solids is proportional to the rate of rotation of the cylinder. Thus, reducing the speed of the rotation of the drum to reduce bed transport rate will penalize the rate of heat transfer in the drum. This would necessitate the use of larger, low-speed dryers to yield the same heat transfer capacity achieved in smaller, high-speed dryers.

Aside from variations in cylinder slope and rotational speed to regulate the rate of bed transport in rotary cylinders, it has also been customary to install dam rings in suitable positions in the interior of the cylinder to force the accumulation of the bed behind the dam ring until the bed level reaches the overflow point of the ring. This again leads to a relatively inflexible situation in that the volume of the retained bed behind the dam ring remains fixed by the geometry of the dam rings regardless of drum speed, air flow rate, slope, or dryer feed rate. There will be longer retention times at low feed rates and shorter retention times at high feed rates. Such as relationship could be detrimental to the drying of thermally sensitive material for which the retention time under all circumstances of operation should be held at a minimum. Excessive retention time is also wasteful on the cylinder driving power, since unnecessary bed retention adds an additional load to the cylinder drive.

A further disadvantage of the dam ring method of bed rate control is the fact that bed depth is not constant, but diminishes progressively in a direction upstream from the dam ring. The diminishing bed depth results in a decrease of the heat transfer coefficient between the gases in the dryer and the solids.

In view of the above, it is an object of the present invention to provide an improved rotary dryer.

A specific object of the present invention is the provision of a rotary dryer wherein the bed transport rate is relatively insensitive to changes in air rate, rotational speed, and slope.

Another object of the present invention is the provision of a rotary dryer wherein the bed transport rate may be readily changed irrespective of slope, cylinder speed, or air rate.

A further object of the present invention is the provision of a rotary dryer wherein the distribution of the bed upstream from the dam ring is equalized to effect an equilizatin of the heat transfer coefficient.

A still further object of the present invention is the provision of an improved combined rotary dryer-cooler which utilizes co-current drying gas and counter-current cooling gas.

According to the present invention, there is provided a rotary dryer comprising a cylindrical shell, the interior of which is provided with at least one set of circumferentially spaced flights and a dam ring. The dam ring is spaced downstream of the flights to provide a flight-free area. Means are provided capable of transporting material from the flight-free area over the dam ring to the downstream side thereof and which is adjustable to vary the amount of material retained upstream from the dam ring.

According to a further form of the invention, means may also be provided to convey material from the flight-free zone to a point adjacent the upstream end of the flights.

In addition, the cylindrical shell may be provided with a cooling section comprising a plurality of flights. Means for supplying co-current drying gas is provided at the feed end of the dryer and means for supplying cooling gas is provided adjacent the discharge end.

DESCRIPTION OF THE DRAWINGS

The above objects and advantages of the present invention may be more readily understood by reference to the following detailed description and to the accompanying drawings, in which.

DETAILED DESCRIPTION

Figure 1:
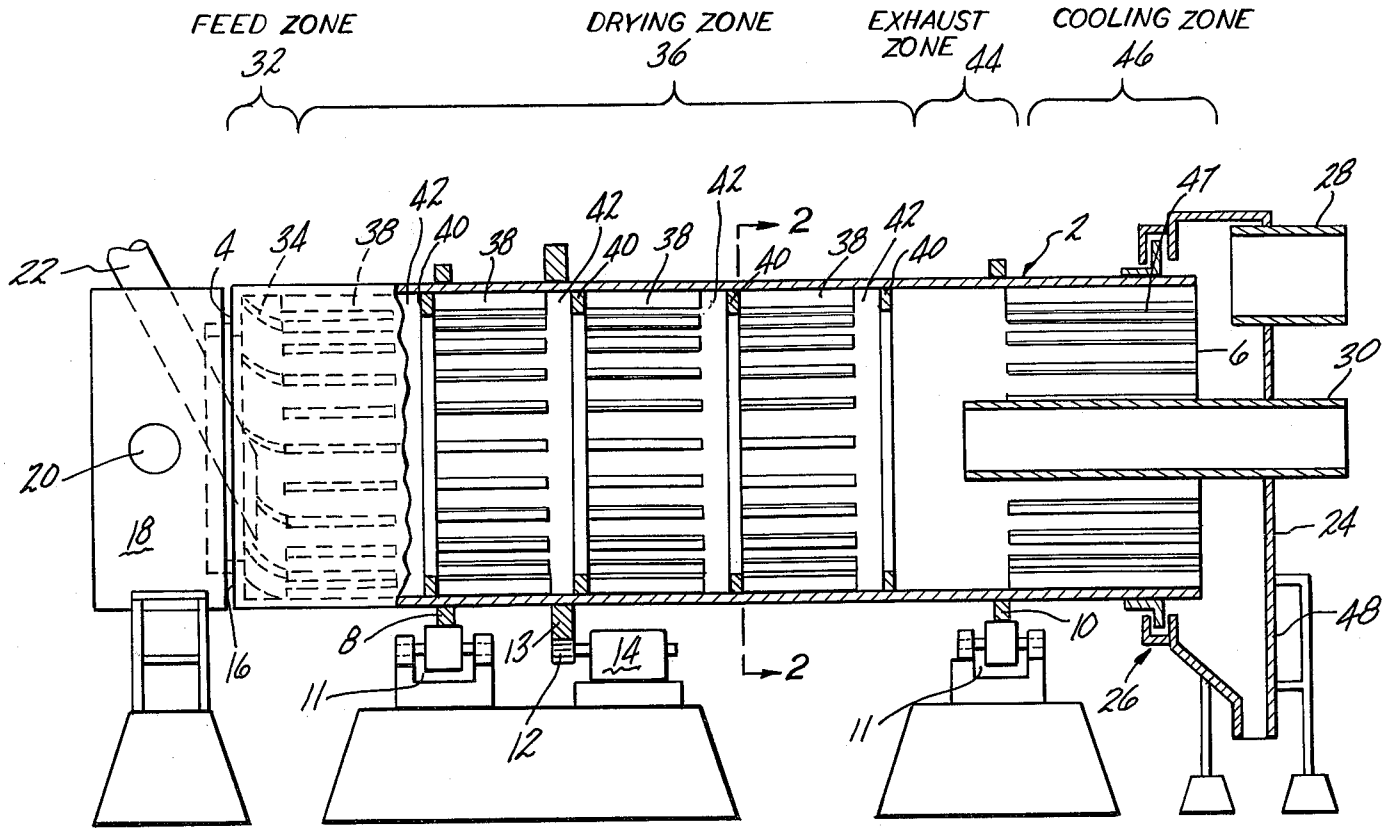
FIG. 1 is an elevational view, partially in section, of a rotary dryer which may be used in practicing the present invention although some of the features of the present invention are omitted from this figure for the sake of clarity.

Referring to the drawings, and in particular FIG. 1, the rotary dryer of the present invention includes generally a hollow cylindrical shell 2 having a feed end 4 and a discharge end 6. Two riding rings 8 and 10 are mounted on the external peripheral surface thereof. The shell 2 is mounted for rotation about its axis of elongation with the riding rings 8 and 10 riding on a trunion roll assemblies 11. The axis of rotation may be tilted slightly from the horizontal with the discharge end 6 being the lower. Suitable thrust bearings (not shown) may be provided as well known in the art to limit axial movement of the shell 2. A ring gear 13 is also provided on the exterior surface of the shell 2 for engaging a suitable gear 12 of the drive assembly 14. The drive assembly 14 could be used to drive the trunion rolls instead of the ring gear 13 if desired.

The opening in the feed end 4 of the shell 2 is reduced by means of a plate member 16 to prevent spillage of the bed out of the feed end. A stationery housing 18 is provided in overlapping arrangement with the feed end 4 of the shell 2 and includes a drying gas inlet 20 and a feet chute 22 which extends into the interior of the shell 2.

A stationery end housing 24 overlaps the discharge end of the shell 2. The shell 2 and end housing 24 are provided with seal means 26 to provide a relatively rotatable seal between them. The end housing 24 is provided with a cooling gas inlet duct 28 and an exhaust duct 30. In the case of co-current drying, duct 30 exhausts the depleted drying gas as well as the counter-current cooling air gas. The drying section of the dryer can be converted to counter-current gas flow by using duct 30 as the entry for heated gas with the depleted drying and cooling gases being exhausted through duct 20.

The shell 2 contains a plurality of functional zones. The first zone is a feed zone 32 which contains a plurality of radially extending spiral flights 34 extending from the inner surface of the shell 2. The drying zone 36 contains at least one set of circumferentially spaced, radially extending flights 38 and a dam ring 40. The dam ring 40 is spaced downstream of its associated flights 38 forming a relatively short section 42 of the inner wall of the shell 2 which is free of flights 38 (hereafter referred to as a flight-free area). As we noted in FIG. 1, according to the preferred embodiment, there is provided four sets of circumferentially spaced flights and a dam ring. After the last dam ring 40, the inner wall of the shell 2 is bare, forming the exhaust zone 44 which separates the drying zone 36 from the cooling zone 46. The duct 30 has its opening positioned in the exhaust zone 44. The cooling zone 46 is provided with a plurality of radially extending flights 47.

The end housing 24 may be provided with a discharge chute 48 through which the material passes after it has been discharged from the shell 2.

Figure 2:
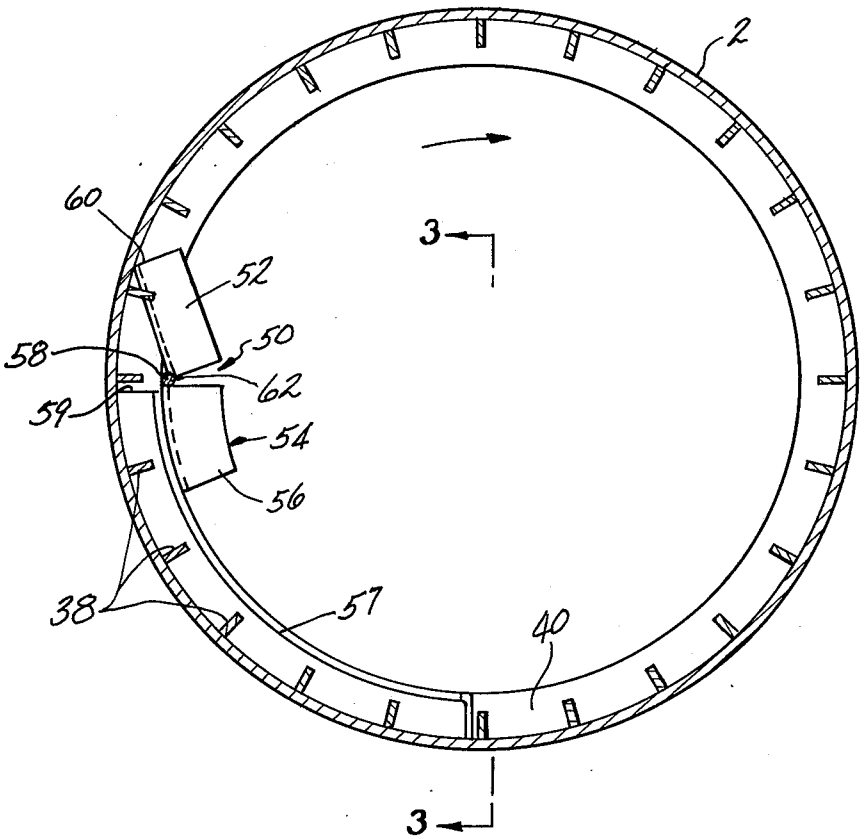
FIG. 2 is a cross-sectional view taken along the lines 2—2 of FIG. 1 and showing various features of the present invention.
Figure 3:
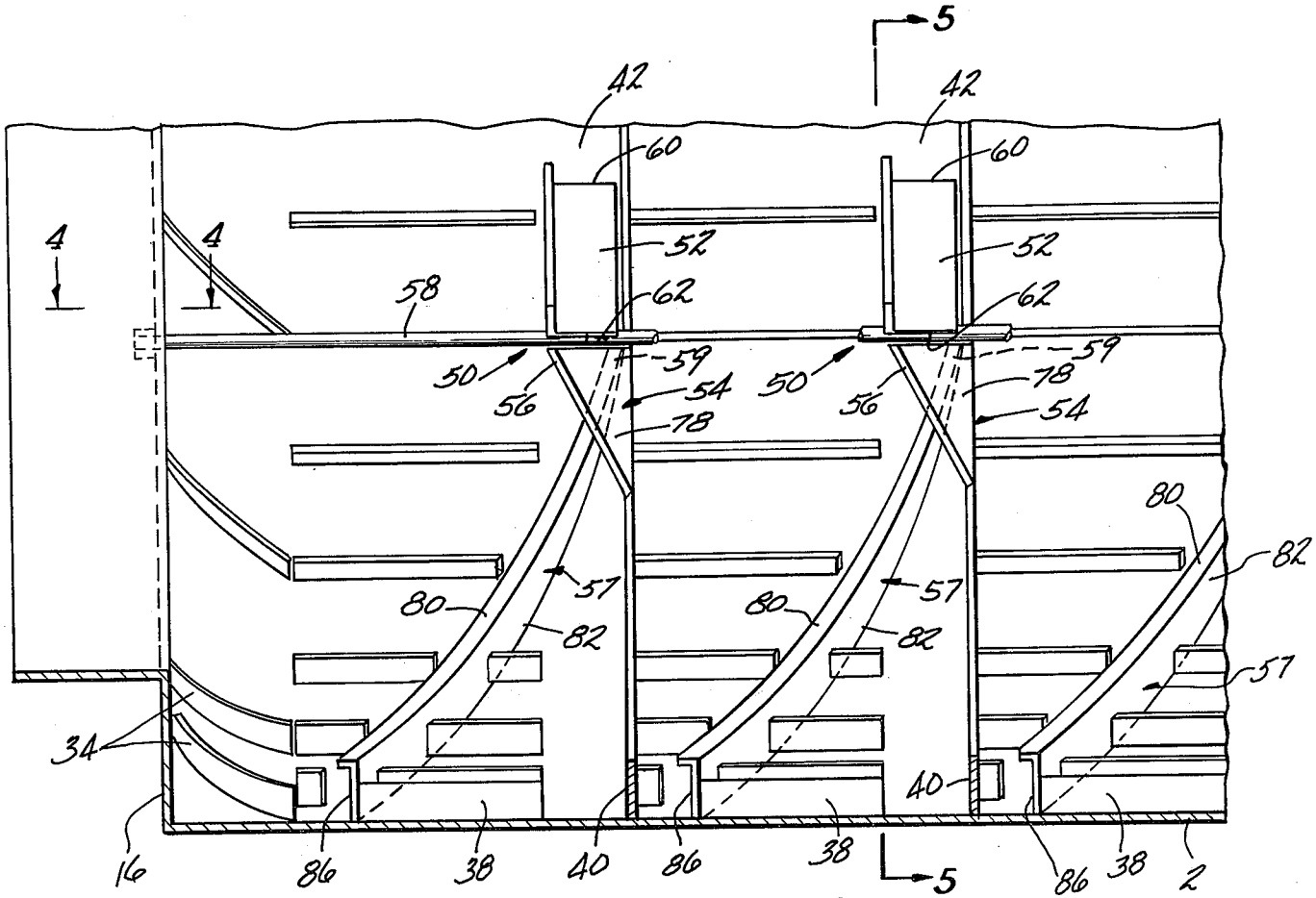
FIG. 3 is a partial sectional view taken along the lines 3—3 of FIG. 2.

Referring now to FIGS. 2 and 3, each of the flight-free spaces 42 associated with a set of flights 38 and dam ring 40 is provided with a bed depth regulator assembly 50. The bed depth regulator assembly 50 comprises in general a scoop 52, the leading edge 60 of which is adjustable so that the distance between the leading edge and the inner wall of the drum 2 can be varied. The bed depth regulator assembly 50 also includes a deflector vane 54, including a wall portion 56 which ensures that the solids pass over the dam ring to the downstream side thereof.

An upstream conveyor 57 may also be provided having its leading edge 59 positioned in the flight-free zone 42 to the rear of the scoop 52 and its discharge end positioned adjacent to upstream end of the flights 38.

The upstream conveyor 57 serves to move solids toward the feed end of the dryer to provide for the redistribution of the solids upstream from the dam ring during each revolution of the shell 2.

More in detail, the flights 38 of each flight and dam ring section may be of any shape known in the art. For example, they may be of relatively simple radial shape or of a compound shape with an angled lip extension attached to the edge remote from the drum wall. The dam member 40 may be a simple ring-shaped member, the outer periphery of which is attached to the inner cylinder wall.

The minimum width of the flight-free zone 40 is established by the amount of forward transport of the bed during a single cascade of the solids in the shell 2. For intervals of relatively small width, the solids originating on the upstream side of the dam ring can be deposited on the downstream side of the dam ring, thereby negating the effectiveness of the dam ring. Under the conventional transport rates, flight-free zones in the range of 1/20 to 1/10 of the diameter on the dryer usually suffices to assure maximum dam ring effectiveness. Excessively large flight-free zones result in the unnecessary decrease of the heat transfer capacity of the dryer, since heat transfer of the flight-free zones is negligible.

Maximum heat transfer capability requires that the shell be operated at an optimum speed of rotation which generally conforms to the formula:

$$RPM = 20\sqrt{3/D}$$

where D is the diameter of the shell in feet and RPM designates revolutions per minute. At the optimized speed of rotation, the flight shape is satisfied by simple radial vanes with the height of the vanes 1/15 to 1/30 of the shell diameter. The height of the vanes is in proportion to the maximum weight of the bed to be retained, and is generally less than the height of the dam rings. Sixteen to twenty-four vanes at uniform intervals on the interior periphery of the shell 2 usually suffices to optimize the heat transfer capability. For operation of the shell at speeds less than the optimum speed, the flights may be made relatively larger and may also be fitted with bent or curved lips to maximize the heat transfer capability at lower speeds.

The flights 38 and dam rings 40 have opposing characteristics in the shell 2 with respect to bed transport. Solids cascading from the flights are transported forward in the direction of air flow and slope of the axis of the shell 2. Solids accumulating in the free-flight area 42 upstream of the dam ring are prevented from forward transport by the blocking action of the dam ring until the depth of the solids exceeds the height of the dam ring. Thus, with dam rings of a predetermined fixed height, the depth of the bed of solids retained upstream from the dam rings will also be fixed.

The bed depth regulator 50 provides a simple and effective control of the depth of the solids upstream from the dam rings. According to the preferred embodiment of the invention, the scoop 52 of the bed depth regulator 50 is attached to an elongated control rod 58. The control rod may be supported on the inner circumference of the dam rings in suitable bearings (not shown) to permit rotary motion and extends through the end plate 16 at the feed end 4 of the shell 2.

The length of each scoop 52 should be sufficient so that upon rotation of the control rod 58, the leading edge 60 will contact the internal wall of the cylindrical shell. Scoop lengths of 1.0 to 5 or more times the height of the dam ring are practical and operable. The trailing edge 62 should be spaced from the internal wall of the shell a distance at least as great as the height of the dam ring 40.

Figure 4:
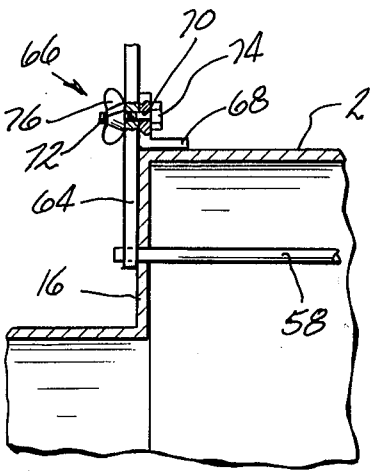
FIG. 4 is a partial sectional view taken along the lines 4—4 of FIG. 3.

As shown in FIG. 4, in order to provide for exterior control of the scoops 52, the control rod 58 extends through the end plate 16 of the shell 2. A handle member 64 may then be attached to the end of the control rod 58. Clamp means 66 may also be provided to maintain the control rod 58 in the desired position. Such clamp means may include a bracket 68 mounted on the cylindrical shell 2 and provided with a suitable elongated arcuate opening 70. The handle member 64 may be provided with a cylindrical hole 72 so that a bolt 74 may be passed through the openings 70 and 72 and a nut member 76 attached to the threaded end of the bolt 74. The nut member 76 may be loosened and the handle 64 moved to adjust the scoop 52. When the scoop 52 is in the desired position, the nut member 76 may be tightened, thereby holding the handle 64 and control rod 58 in the required position. In lieu of this manual arrangement for positioning the control rod 58, other remote control means using hydraulic, pneumatic, electrical, or mechanical motivation may be employed.

The deflector vane 54 is positioned immediately rearwardly (according to the direction of rotation of the drum) of the scoop 52. The deflector vane 54 may be an integral extension of the movable scoop 52 or may be nonmovable. As shown, the deflector vane includes a plate portion 78 attached to the inner circumference of the dam ring 40 and which serves to prevent the material coming from the trailing end 62 of the scoop 52 from falling down into the flight-free zone 42. The wall portion 56 is integral with the plate portion 78 and is positioned at an angle so that it channels the material toward the discharge end 6 of the shell 2 over the dam ring 40.

The scoop 52 is adjustable between a zero bed depth setting, wherein the leading edge 60 is in engagement with the internal periphery of the shell 2 and a full bed depth wherein the leading edge of the scoop 52 is positioned from the internal wall of the shell 2 a distance at least equal to the height of the dam ring 40.

Figure 5:
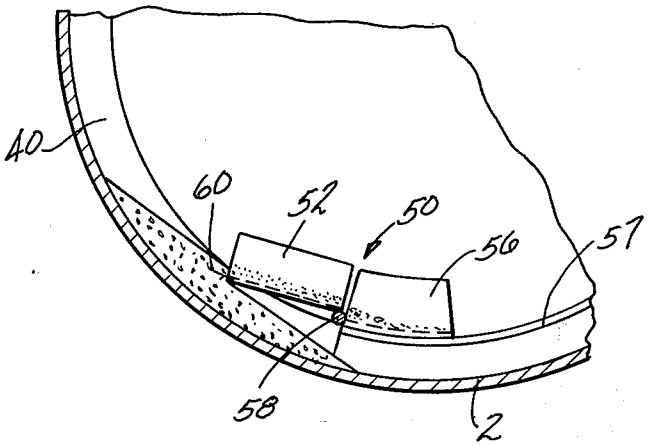
FIG. 5 is a view taken along the lines 5—5 of FIG. 3 but showing the drum rotated into a position to show the relative position of the rolling bed of solids in relation to the dam ring and the bed transfer means.

FIG. 5 shows the operation of the adjustable scoop 52 and the manner in which it reduces the bed depth. As shown in FIG. 5, with the scoop positioned as shown a portion of the solids in the free-flight zone 42 enter the scoop and are elevated to a level above the interior circumference of the dam ring 40 during each revolution of the drum. On continued rotation, the solids flowing out of the opposite end of the scoop are deflected across the top of the dam ring 40 by the deflector vane 54. With the scoop positioned against the interior wall of the shell 2, all solids in the free-flight area 42 will enter the scoop and be deflected across the top of the dam ring 40. As the scoop is moved away from the shell wall, additional solids are caused to be retained in the drum, thereby delaying the rate of bed transport and extending the retention time of the solids in the drum. When the leading edge of the scoop 52 reaches the height of the dam ring 40, only excess solids overflow the dam ring, thereby establishing the maximum volume of the bed of solids, which may be retained.

When the type or composition of the product to be dried changes, or when the dryer operation is terminated for any reason whatsoever, the residual bed in the dryer must be removed completely. This may be effected by setting the scoops 52 in contact with the internal shell wall at zero bed depth. Continued rotation of the drum will result in the bed being completely removed.

The upstream conveyors 57 may be of any suitable type which will serve to transport material from the flight-free zone 42 to a point upstream thereof. As shown, the upstream conveyor 57 is a helical angle member with one side 80 of the angle being positioned toward the inside of the shell 2 and the other side 82 of the angle positioned toward the discharge end 6 of the shell 2. However, a channel shaped member with one leg of the channel in contact with the inner periphery of the shell 2 may also be used.

The loading end 59 of the conveyor 57 is positioned in the flight-free area 42 behind the movable scoop 52. The discharge end 86 of the conveyor is positioned at a point adjacent the upstream end of the flights 40. The positioning of the scoop 52 ahead of the loading end 84 of the conveyor 56 establishes priority control of the bed of material for the scoop. The scoop 52 can deactivate the function of the conveyor 56 when the scoop 52 is in engagement with the inner wall of the shell 2.

The number and length of the combined flight and dam ring sections depends upon various considerations. The upstream conveyors 57 provide for the mixing and blending of the bed contained between successive dam rings. Due to this mixing and blending action, the maximum variation of moisture and temperature in samples removed from a given section is relatively small compared to the variation in temperature and moisture in samples taken from adjacent sections. As the number of sections is increased, the difference in moisture and temperature between samples from adjacent sections becomes smaller. Where relatively large temperature differences can be tolerated, only a single section of flights and dam rings may be required. Where large differences in temperature and moisture between intermediate materials and adjacent sections of the dryer is not desired or cannot be tolerated, then the total length of the drying section should be subdivided into the appropriate number of subsections required to reduce temperature and moisture differences between adjacent subsections to tolerable values.

In general, three to six subsections will usually suffice. The use of more than ten subsections will result in the dryer length being unnecessarily extended since each dam ring must be preceeded by flight-free zone of sufficient length to prevent the uncontrolled escape of cascading material from the section.

If desired, the shell, according to the invention, may be supplied with a cooling zone 46 as described above. Combined co-current drying and counter-current cooling is practical according to this invention in view of the fact that the dryer axis can be set at a sufficient slope to induce forward transport of the bed in spite of the countercurrent flow of the cooling air. The excessively high rate of bed transport that would normally take place in the cocurrent drying section due to the axial slope is avoided in view of the bed retention by the dam rings. Normally, dryers and coolers operated with bed transport solely under control of forces originating with air flow and slope of the drum axis require the use of two separate co-current drying and counter-current drums, each set at a different axial slope, to compensate for bed transport due to air flow. Other combinations of co-current and counter-current air flow for drying and cooling is also possible with the variable bed depth and dam rings of the present invention.

The overall operation of the dryer is as follows. With the shell 2 rotating at the desired speed in the direction of the arrow of FIG. 2, moist or wet solids are fed into the shell through the chute 22. The drying gas enters the inlet 20 and flows through the shell 2 and exits through duct 30. Cooling gas enters the duct 28, flows through the cooling zone 46, and also exits through duct 30. For the sake of economy, the drying gas is preferably heated air and the cooling gas may either be ambient or cooled air.

The spiral flights 34 in the feed zone 32, along with the transport forces due to air flow and shell slope, feed the solids into the drying zone 36. The flights 38 lift and shower the solids for intimate contact with the drying air. The solids tend to build up at the upstream side of the dam rings 40 in the flight-free section 42. Upon each rotation of the drum, the bed depth regulator 50, which is set for the desired bed depth, transports a portion of the solids, over the dam ring 40 into the next set of flights and dam ring or, in the case of the last set, into the air exhaust zone.

The material in the flight-free section not transported over the dam ring enters the helical conveyor 57 and is conveyed upstream to blend with other solids. This procedure continues, with some solids being transported over the dam ring and others being conveyed back upstream.

The solids in the exhaust zone are transported by forces due to the slope of the shell 2 to the cooling zone. In the cooling zone, the solids are lifted and showered by the flights 47 for intimate contact with the cooling air. After passing through the cooling zone 46, the solids are discharged into the end housing 24 and exit through the discharge chute 48.

When it is desired to empty the shell, the bed depth regulator assembly 50 is set to the zero bed depth, whereat the leading end 62 thereof is in engagement with the internal shell wall. Upon each revolution, all the solids ahead of the regulator assembly 50 will be transported over the dam wall and eventually out through the discharge end 6 of the shell 2. After a short period of time, the shell will be substantially empty of all solids since there can be no buildup of solids on the upstream side of the dam rings.

The following examples are intended to further illustrate the present invention and are offered without any intent to pose any limitations upon the present invention.

EXAMPLE 1

A dryer including a cylindrical shell 8 feet in diameter and 24 feet long was operated at 10 rpm at a forward slope of 0.01 feet per foot. The cylindrical shell was divided into a drying section 16 feet long containing 4 sections of flights and dam rings, a bare section 3 feet long from which air was exhausted, and a terminal cooling section of 5 feet. Each flight and dam ring section consisted of 24 radial flights 4 inches high and 36 inches long uniformly spaced around the internal wall of the shell. A dam ring 6 inches high was placed at a distance of 8 inches downstream from the end of the flights of each section. Each flight section was provided with a helical conveyor for transport of the bed from the flight-free section to a position near the upstream end of the flights. Scoops were provided in each of the flight-free sections. The scoops were supported from a hinged control rod which extended parallel to the axis of the dryer and which terminated on the exterior of the end of the dryer. A control handle and clamping means were installed to permit simple manual variation of the position of the adjustable scoops. Deflector plates were provided for directing the bed flowing from the scoops into the downstream side of the dam rings. Helical flights were installed in the feed end of the dryer for an axial length of 16 inches to prevent spillage of the feed into the end housing. A cooling section was provided with 24 radial flights 4 inches high and 60 inches long.

Moist calcium hypochlorite was supplied to the dryer at the rate of 4,000 pounds per hour. The moisture to be removed was 0.30 pounds per water per pound of dry product. Air, heated to 350° F was supplied at the rate of 36,000 pounds per hour. Heat transfer limitations encountered at the 10 rpm operating speed of the shell required bed retention in the drying zone of 15 minutes. The required bed volume for 15 minutes retention time was 20 cubic feet. The adjustable scoops were set at a position in which bed retention amounted to 2.5 percent cross-sectional loading. The loss of active chlorine during the drying period was 1.5 percent.

In the absence of the dam rings, the transport rate, as established by the forces of air flow and forward axial slope would have been at the rate of 4 feet per minute, whereby the bed would have transversed the drying zone in 4 minutes. This would have been insufficient to provide the 15 minute retention established on the basis of heat transfer limitations.

Bed transport through the cooling section attributable to forward slope of the axis was 2 feet per minute. Countercurrent cooling air volume was set at 18,000 pounds per hour to reduce this rate to 1 foot per minute. This resulted in a 5 minute retention time of the bed in the cooling section of the dryer which satisfied the 5 minute bed retention time required to satisfy limitations in the heat transfer coefficient.

EXAMPLE 2

When the drying of the calcium hypochlorite fed to the dryer in Example 1 had been completed, the dryer was stopped momentarily while the adjustable scoops were reset to the zero bed depth position. The dryer was then restarted and operated for 20 minutes during which time all solids in the dryer were transported to the discharge end by the normal transport forces induced by the co-current air flow and the forward slope of the drum axis.

EXAMPLE 3

By way of illustration, moist calcium hypochlorite was dried in a conventional rotary dryer at the rate of 4,000 pounds per hour. The dryer was 8 feet in diameter, 32 feet long, and rotated at 2.5 rpm. The moisture removed was 0.30 pounds of water per pound of dry product. Air heated to 350° F was required at the rate of 36,000 pounds per hour. The required bed retention time as limited by the heat transfer coefficient was 60 minutes. As the bed transport forces induced by air flow resulted in bed movement of 0.5 feet per minute, the slope was set at zero with co-current air flow to provide the necessary 60 minute retention time of the bed. Because of the 60 minute bed retention time, the loss of active chlorine during drying amounted to 6 percent, as compared to 1.5 percent as set forth in Example 1.

The product was discharged at 175° F and was transferred to a rotary cooling drum in counter-current contact with 9,000 pounds per hour of air at 80° F. The cooler was 6 feet in diameter and 20 feet long. In order to obtain the required retention time, the cooler had to be set on a forward slope axial of 0.03 feet per foot to counteract the retarding force of the counter-current air flow and to induce forward transport of the bed at the rate of 1.0 foot per minute, which would result in the 20 minute retention time.

What is claimed is:

1. A rotary dryer for solid material, comprising:

a. a hollow cylindrical shell having an upstream feed end and a downstream discharge end;

b. at least one set of circumferentially spaced flights;

c. an annular dam ring means, attached to the interior of said shell and projecting inwardly from said shell, said dam ring being spaced from said flights toward the discharge end of said shell, for forcing limited accumulation of a bed of material upstream from and adjacent to said dam ring;

d. a flight-free area in said shell between said flights and said dam ring; and e. bed depth regulator means, attached to said dryer, for regulating the depth of said bed by transporting a selected portion of said bed of material from said flight-free area over said dam ring to the downstream side thereof upon rotation of said shell.

2. The rotary dryer of claim 1 wherein said bed depth regulator includes an adjustable scoop means for scooping that portion of said bed in said free flight area and more than a selected height above the interior surface of said shell and elevating said scooped solids to a position above the interior circumference of said dam ring, thereby reducing the effective height of said dam ring to the radial distance of said scoop means from said shell.

3. The rotary dryer of claim 2 wherein each of said scoops is mounted on a control rod, said control rod being rotatable and extending externally of said shell, and means attached to said control rod for rotating said rod.

4. The rotary dryer of claim 3 further including means for holding said control rod in a given position after rotation.

5. The rotary dryer of claim 2 wherein said transport means further includes deflector vanes for deflecting material from said scoop means over said dam ring upon rotation of said shell.

6. The rotary dryer of claim 1 further including coveying means associated with each of said sets of flights and a dam ring for conveying material from said flight-free area to a point adjacent the upstream end of said flights so as to maintain a more even distribution of said bed of material throughout the region from the upstream end of said flights to the dam ring, thereby achieving a unifrom regulable bed depth substantially independent of air flow rates and rotational speeds.

7. The rotary dryer of claim 6 wherein said conveying means includes a helical conveyor having its leading end behind the loading position of said bed depth regulator means in said flight-free area according to the direction of rotation of said shell.

8. The rotary dryer of claim 1 wherein there are a plurality of said sets of flights and a dam ring in said shell.

9. The rotary dryer of claim 8 wherein there are 3 to 6 of said sets of flights and a dam ring in said shell.

10. A rotary dryer for solid material comprising:

a. a hollow cylindrical shell having a feed end and a discharge end;
b. a drying section in said shell;
c. a cooling section in said shell downstream of said drying section;
d. at least one set of circumferentially spaced flights and a dam ring in the interior of said shell in the drying section, said dam ring being spaced from said flights toward the discharge end of said shell thereby providing a flight-free area in the shell between said flights and said dam ring;
e. transport means associated with each of said sets capable of transporting material from the flight-free area over said dam ring to the downstream side thereof upon rotation of said shell and being adjustable to vary the amount of material retained upstream from said dam ring;
f. a plurality of circumferentially spaced flights in said shell in the cooling section spaced from the downstreammost dam ring;
g. means for introducing drying gas into said shell for co-current flow with the material; and
h. means for introducing cooling gas into said shell for counter-current flow with respect to said solid material.

11. The rotary dryer of claim 10 wherein the axis of said shell is inclined with respect to the horizontal so that the interior of said shell slopes downwardly from the feed end to the discharge end.

12. The rotary dryer of claim 10 further including an outlet for the cooling and drying gas, said outlet having its opening in a plane transversing said shell between the downstreammost dam ring of the drying section and the upstream end of the flights of the cooling section.

13. The rotary dryer of claim 10 wherein said transport means includes an adjustable scoop having a leading edge capable of being positioned at various distances from the interior wall of said shell and a trailing end spaced radially inwardly from the interior wall of said shell a distance at least as great as the height of said dam ring.

14. The rotary dryer of claim 13 wherein each of said scoops is mounted on a control rod, said control rod being rotatable and extending externally of said shell, and means attached to said control rod for rotating said rod.

15. The rotary dryer of claim 14 which further includes means for holding said control rod in a given position after rotation.

16. The rotary dryer of claim 10 wherein said transport means further includes deflector vanes for deflecting material from said scoop over said dam ring upon rotation of said shell.

17. The rotary dryer of claim 10 which further includes conveying means associated with each of said sets of flights and dam ring for conveying material from said flight-free area to a point adjacent the upstream end of said flights.

18. The rotary dryer of claim 17 wherein said conveying means includes a helical conveyor having its leading end behind the loading position of said transport means in said flight-free area according to the direction of rotation of said shell.

19. The rotary dryer of claim 10 wherein there are a plurality of sets of flights and a dam ring in said shell.

20. The rotary dryer of claim 10 wherein there are 3 to 6 of said sets of flights and a dam ring in said shell.

21. A method of drying solid material in a rotary dryer having a rotating shell supplied with drying gas, said method comprising:
a. transporting said material through said shell by transport forces induced by gas flow and axial slope of the shell;
b. reducing the rate of travel through said shell normally obtained by the transport forces of the drying gas and axial slope through the use of at least one dam ring and a flight-free zone immediately upstream of said dam ring;
c. regulating the depth of solids retained behind said dam ring by scooping at least a portion of the solids over said dam ring to a downstream side thereof upon rotation of said shell; and
d. conveying at least a portion of the solids remaining in the flight-free area upstream therefrom, so as to distribute said regulated depth of retained solids throughout a region extending upstream from and including said flight-free area.

22. The method of claim 21 wherein a plurality of dam rings is used to reduce the rate of travel.

* * * * *